US009379433B2

(12) United States Patent
Ying

(10) Patent No.: US 9,379,433 B2
(45) Date of Patent: Jun. 28, 2016

(54) MULTIPLE-INPUT MULTIPLE-OUTPUT (MIMO) ANTENNAS WITH MULTI-BAND WAVE TRAPS

(75) Inventor: Zhinong Ying, Lund (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 739 days.

(21) Appl. No.: 13/697,943

(22) PCT Filed: Jan. 5, 2012

(86) PCT No.: PCT/IB2012/000012

§ 371 (c)(1), (2), (4) Date: Nov. 14, 2012

(87) PCT Pub. No.: WO2013/064872

PCT Pub. Date: May 10, 2013

(65) Prior Publication Data

US 2014/0368398 A1 Dec. 18, 2014

Related U.S. Application Data

(60) Provisional application No. 61/553,693, filed on Oct. 31, 2011.

(51) Int. Cl.

| | |
|---|---|
| ***H01Q 1/52*** | (2006.01) |
| ***H01Q 21/00*** | (2006.01) |
| ***H01Q 1/48*** | (2006.01) |
| ***H01Q 5/307*** | (2015.01) |
| *H01Q 1/22* | (2006.01) |
| *H01Q 1/24* | (2006.01) |
| *H01Q 21/28* | (2006.01) |

(52) U.S. Cl.

CPC ..... *H01Q 1/523* (2013.01); *H01Q 1/48* (2013.01); *H01Q 1/521* (2013.01); *H01Q 1/526* (2013.01); *H01Q 5/307* (2015.01); *H01Q 1/2291* (2013.01); *H01Q 1/243* (2013.01); *H01Q 21/28* (2013.01)

(58) Field of Classification Search

CPC ..... H01Q 1/243; H01Q 1/48
USPC ..... 343/841
See application file for complete search history.

(56) References Cited

U.S. PATENT DOCUMENTS

2011/0169703 A1 7/2011 Schlub et al.
2012/0094717 A1* 4/2012 Bahramzy ..... 455/557

FOREIGN PATENT DOCUMENTS

CN 201430211 Y 3/2010
CN 101901962 A 12/2010

(Continued)

OTHER PUBLICATIONS

Chinese Office Action issued Jan. 4, 2014 for Chinese Application No. 201280053033.1, including translation (16 pages).

(Continued)

*Primary Examiner* — Dameon E Levi
*Assistant Examiner* — Ricardo Magallanes
(74) *Attorney, Agent, or Firm* — Myers Bigel & Sibley, P.A.

(57) ABSTRACT

An antenna includes a first radiating element, a second radiating element, a common ground plane between the first radiating element and the second radiating element, and a wavetrap structure coupled to the ground plane and configured to reduce correlation between the first and second radiating elements at first and second RF frequencies.

9 Claims, 11 Drawing Sheets

(56) References Cited

FOREIGN PATENT DOCUMENTS

| | | | |
|---|---|---|---|
| CN | 102148423 | A | 8/2011 |
| EP | 1 271 688 | A1 | 1/2003 |
| EP | 1271688 | A1 | 1/2003 |
| EP | 2083472 | A1 | 7/2009 |
| JP | 2008-017047 | | 1/2008 |
| JP | 2008-245132 | | 10/2008 |
| JP | 2008245132 | A | 10/2008 |
| WO | WO 2010/065356 | A1 | 11/2009 |

OTHER PUBLICATIONS

International Preliminary Report on Patentability corresponding to International Application No. PCT/IB2012/000012, Date of mailing: May 15, 2014; 15 pages.

Kim et al., "Design of a Dual-Band MIMO Antenna for Mobile WiMAX Application," Microwave and Optical Technology Letters, vol. 53, No. 2, Feb. 2011, pp. 410-414.

International Search Report and Written Opinion for PCT Application No. PCT/IB2012/000012 mailed Jun. 21, 2012.

* cited by examiner

MULTIPLE-INPUT MULTIPLE-OUTPUT (MIMO) ANTENNAS WITH MULTI-BAND WAVE TRAPS

CROSS-REFERENCE TO RELATED APPLICATION

This application is a 35 U.S.C. §371 national stage application of PCT International Application No, PCT/IB2012/000012, filed on 5 Jan. 2012, which claims priority to U.S. Provisional Patent Application No. 61/553,693 filed 31 Oct. 2011, the disclosures and contents of which are incorporated by reference herein as if set forth in their entireties.

FIELD OF THE INVENTION

The present application relates generally to communication devices, and more particularly to, multiple-input multiple-output (MIMO) antennas and wireless communication devices using MIMO antennas.

BACKGROUND

Wireless communication devices, such as WIFI 802.11N and LTE compliant communication devices, are increasingly using MIMO antenna technology to provide increased data communication rates with decreased error rates. A MIMO antenna includes at least two antenna elements.

MIMO technology may offer significant increases in data throughput and/or transmission range without the need for additional bandwidth or transmit power. It can achieve this due to the ability of MIMO to obtain higher spectral efficiency (more bits per second per hertz of bandwidth) and/or reduced fading.

MIMO based systems allow the use of a variety of coding techniques that take advantage of the presence of multiple transmit and receive antennas. For example, wireless communications performed over a MIMO channel can use beamforming, spatial multiplexing and/or diversity coding techniques.

The operational performance of a MIMO antenna depends upon obtaining sufficient decoupling and decorrelation between its antenna elements. It is therefore usually desirable to position the antenna elements far apart within a device and/or to use radiofrequency (RF) shielding therebetween while balancing its size and other design constraints, Correlation between antennas can also be reduced by causing the antennas to have different polarizations, i.e. sending and receiving signals with orthogonal polarizations. Furthermore, antennas for MIMO systems may utilize spatial separation, or physical separation, to reduce correlation between antennas. Either of these approaches can be unsatisfactory for handheld mobile devices, however, as it is generally desirable for the handheld devices to have compact antennas.

SUMMARY

An antenna according to some embodiments includes a first radiating element, a second radiating element, a ground plane between the first radiating element and the second radiating element, and a wavetrap structure coupled to the ground plane and configured to reduce correlation between the first and second radiating elements at first and second RF frequencies.

The wavetrap structure may include a ground post connected to the ground plane and a conductive strip coupled to the ground post and having a length that is one quarter of a wavelength of the first RF frequency.

The antenna may further include a capacitive element between the ground plane and an end of the first conductive strip opposite the first ground post.

The wavetrap structure may include a second conductive strip coupled to the ground post and having a length that is one quarter of a wavelength of the second RF frequency.

The ground plane may have a first side and a second side opposite the first side. The antenna may further include a first feed element coupled to the first radiating element at a first end of the radiating element proximate the first side of the ground plane, and the ground post may be proximate the second side of the ground plane.

The first and second conductive strips may extend from the ground post toward a second end of the first radiating element opposite the first end of the first radiating element.

In some embodiments, the wavetrap structure may include a first ground post connected to the ground plane, a second ground post connected to the ground plane, a first conductive strip coupled to the first ground post and having an electrical length that is one quarter of a wavelength of the first RF frequency, and a second conductive strip coupled to the second ground post and having an electrical length that is one quarter of a wavelength of the second RF frequency.

The first radiating element may be adjacent the first end of the ground plane and the second radiating element may be adjacent the second end of the ground plane. The first and second ground posts may be proximate the first end of the ground plane. The first conductive strip may extend away from the first ground post toward the first end of the ground plane, and the second conductive strip may extend away from the second ground post toward the first end of the ground plane.

The antenna may further include a first feed element coupled to the first radiating element at a first end of the first radiating element proximate the first side of the ground plane, and a second feed element coupled to the second radiating element at a first end of the second radiating element proximate the first side of the ground plane. The first ground post and the second ground post may be proximate the second side of the ground plane. The first conductive strip may extend from the first ground post toward a second end of the first radiating element opposite the first end of the first radiating element, and the second conductive strip may extend from the second ground post toward the second end of the first radiating element.

The first radiating element may be adjacent the first end of the ground plane and the second radiating element may be adjacent the second end of the ground plane. The first ground post may be proximate the second end of the ground plane, and the second ground post may be proximate the first end of the ground plane. The first conductive strip may extend away from the first ground post toward the first end of the ground plane, and the second conductive strip may extend away from the second ground post toward the second end of the ground plane.

The antenna may further include a first feed element coupled to the first radiating element at a first end of the first radiating element proximate the first side of the ground plane, and a second feed element coupled to the second radiating element at a first end of the second radiating element proximate the second side of the ground plane. The first ground post may be proximate the second side of the ground plane, and the second ground post may be proximate the first side of the ground plane. The first conductive strip may extend from the first ground post toward a second end of the first radiating element opposite the first end of the first radiating element, and the second conductive strip may extend from the second ground post toward a second end of the second radiating element opposite the first end of the second radiating element.

The first and second radiating elements have an envelope correlation coefficient less than 0.5 for a first frequency in the first RF frequency range and for a second frequency in the second RF frequency range.

A wireless terminal according to some embodiments includes a transceiver, and an antenna coupled to the transceiver. The antenna includes a first radiating element, a second radiating element, a ground plane between the first radiating element and the second radiating element, and a wavetrap structure coupled to the ground plane and configured to reduce correlation between the first and second radiating elements at first and second RF frequencies.

An antenna according to further embodiments includes a first radiating element, a second radiating element, a common ground plane for the first and second radiating elements, and a multi-element wavetrap structure configured to reduce a correlation between the first and second radiating elements in first and second spaced apart RF frequency ranges.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Figure 1:
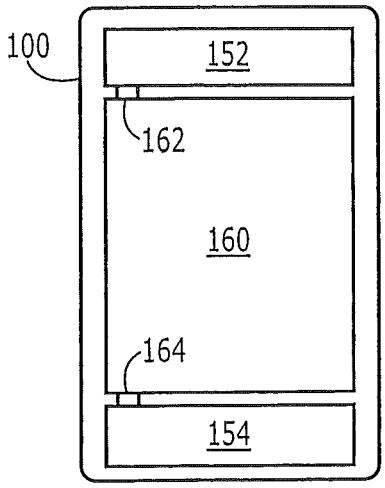
FIG. 1 illustrates an antenna structure including two antennas and a ground plane of a wireless communication device according to some embodiments.

The invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "connected" to another element, it can be directly connected to the other element or intervening elements may be present. In contrast, when an element is referred to as being "directly connected" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

Embodiments of the invention are described herein with reference to schematic illustrations of idealized embodiments of the invention. As such, variations from the shapes and relative sizes of the illustrations as a result, for example, of manufacturing techniques and/or tolerances, are to be expected. Thus, embodiments of the invention should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the invention.

For purposes of illustration and explanation only, various embodiments of the present invention are described herein in the context of a wireless communication terminal ("wireless terminal" or "terminal") that includes a MIMO antenna that is configured to transmit and receive RF signals in two or more frequency bands. The MIMO antenna may be configured, for example, to transmit/receive RF communication signals in the frequency ranges used for cellular communications (e.g., cellular voice and/or data communications), WLAN communications, and/or TransferJet communications, etc.

FIG. 1 illustrates a wireless terminal 100 including a MIMO antenna that includes at least two radiating elements 152, 154. The first and second radiating elements 152, 154 may be formed on a planar substrate, such as on a conventional printed circuit board, which includes a dielectric material, ceramic material, or insulation material. The first and second radiating elements 152,154 are adjacent to a ground plane 160 on the printed circuit board. The first and second radiating elements 152,154 may be formed by patterning a conductive (e.g., metallization) layer on a printed circuit board.

The ground plane 160, which acts as a counterpoise for each of the first and second radiating elements 152 ,154, is positioned between the first and second radiating elements 152, 154.

RF signals are coupled to the first radiating element 152 through a first feed element 162, while RF signals are coupled to the second radiating element 154 through a second feed element 164. The first feed element 162 is coupled to the first radiating element 152 near an end of the first radiating element 152, so that the first radiating element 152 generally extends away from the first feed element 162 along an upper side of the ground plane 160.

Similarly, the second feed element 164 is coupled to the second radiating element 154 near an end of the second radiating element 154, so that the second radiating element 152 generally extends away from the second feed element 164 along a lower side of the ground plane 160.

In general, the efficiency of a single antenna is increased when the antenna excites the fundamental mode of the antenna's counterpoise. However, if both antennas in a MIMO antenna excite the same mode, they will tend to experience mutual coupling. This coupling causes the signals on the antennas to become correlated, which can reduce the performance of the MIMO antenna system.

An additional complexity arises when the MIMO antennas are used in a dual band system, i.e., a system that is intended to operate over more than one frequency range. For example, in a Long Term Evolution (LTE) handset, the antenna may transmit/receive signals in both a 750 MHz band and an 850 MHz band. Within this general frequency range, the correlation of radiating elements that use the same ground plane may be unacceptably high, such as about 0.8 to 0.9.

Mutual coupling between MIMO antennas can be reduced in various ways, such as by using a coupler, LC network and/or a neutralization line. Wavetrap scattering can also be used to improve correlation. However, such an approach may apply only to narrow bandwidths, and tuning may be needed to use such methods in a multiband system. A coupler, LC network and/or neutralization line may only be used for one frequency by itself, and one or more tuning circuits may be needed to realize a reduction in multiband coupling. However, tuning circuits may not be capable of supporting simultaneous multiband (MIMO) applications with carrier aggregation.

Some embodiments reduce MIMO antenna correlation through the use of multiple wavetraps on the ground plane. The wavetraps employ multiple quarter-wave conductive strips coupled to the ground plane through one or more ground posts.

Figure 2A:
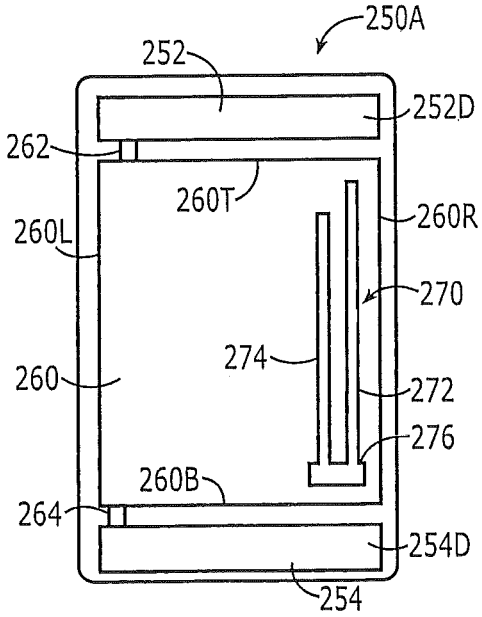
FIGS. 2A and 2B are schematic and perspective drawings that illustrate an antenna structure including two antennas, a ground plane and a multi-band wave stop according to some embodiments.
Figure 2B:
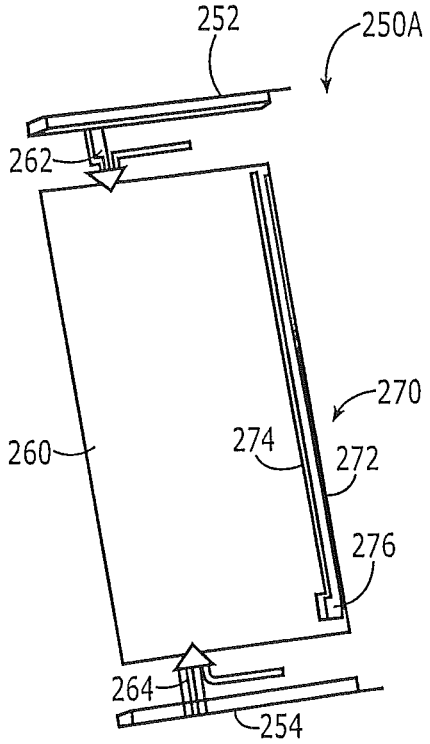
Figure 2C:
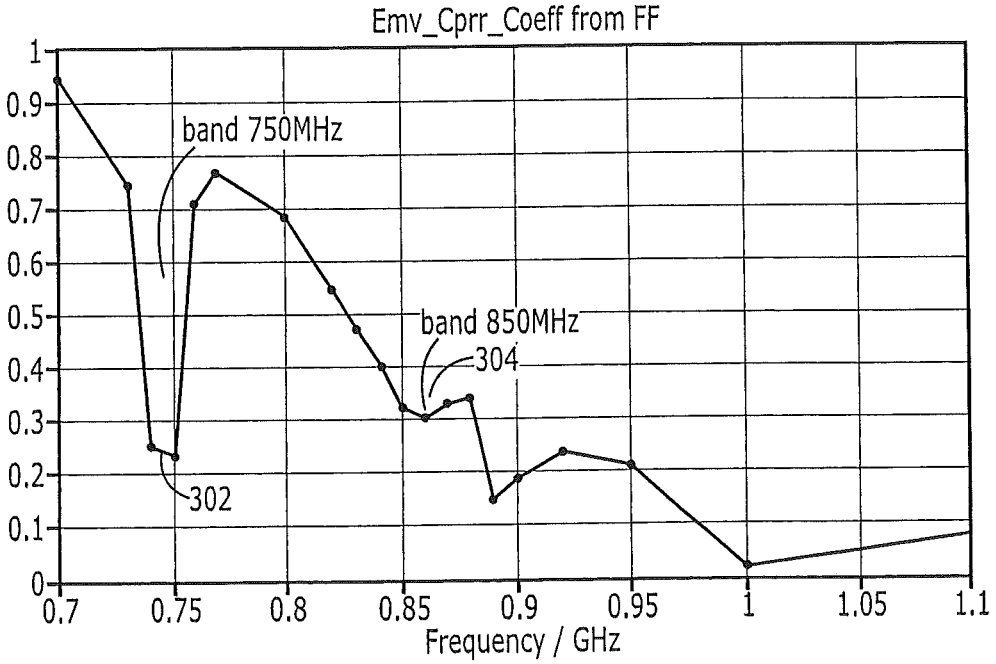
FIG. 2C is a graph of envelope correlation parameter measurements for the antenna of FIG. 2A.

For example, FIG. 2A is a schematic diagram of a MIMO antenna system 250A including dual radiating elements 252, 254 according to some embodiments. FIG. 2B is a perspective view of the MIMO antenna system 250A, while FIG. 2C is a graph of correlation coefficient of the two radiating elements 252, 254 as a function of frequency.

Referring to FIG. 2A and FIG. 2B, the antenna system 250A includes first and second radiating elements 252, 254 that are positioned on opposite sides of a ground plane 260. The first and second radiating elements 252, 254 are fed by first and second feed elements 262, 264, respectively.

The ground plane 260 is generally rectangular and includes first and second sides 260L, 260R that extend between and are generally perpendicular to the first and second radiating elements 252, 254, and first and second ends 260T, 260B that are generally parallel to the first and second radiating elements 252, 254.

In the embodiments illustrated in FIGS. 2A-2B, the first and second feed elements 262, 264 are positioned nearer to the left side 260L of the ground plane 260, so that the radiating elements 252, 254 each include an open end 252D, 254D that is spaced apart from the respective feed element 262, 264 by a distance that is almost the length of the radiating element. It will be appreciated that the open end of a radiating element also corresponds to the highest e-field experienced by the antenna. Energy may be coupled most effectively/easily from the open end of the radiating element.

The antenna system 250A further includes a multi-element wavetrap 270 that is positioned within the periphery of the ground plane 260. The wavetrap 270 includes first and second conductive strips 272, 274 that are coupled to the ground plane 260 by a common ground post 276. The conductive strips 272, 274 run generally perpendicular to the radiating elements 252, 254 near the second (right) side 260R of the ground plane.

The conductive strips 272, 274 may be formed as metal striplines on a dielectric layer that are spaced apart from the ground plane in a dimension normal to the ground plane.

The wavetrap 270 decouples the first and second radiating elements 252, 254 in frequency ranges corresponding to the electrical lengths of the respective conductive strips 272, 274 by guiding and scattering RF energy at wavelengths that are harmonics of the electrical lengths of the respective conductive strips 272, 274. Thus, for example, a wavetrap element including a conductive strip having a length of 85 mm would scatter RF energy at a wavelength of 340 mm corresponding to 850 MHz.

FIG. 2C is a graph of correlation coefficient of the two radiating elements 252, 254 as a function of frequency. As shown therein, the antenna envelope correlation between the two radiating elements 252, 254 at 750 MHz is less than 0.3 (point 302), while the antenna envelope correlation between the two radiating elements 252, 254 at 850 MHz is less than 0.4 (point 304).

Figure 3A:
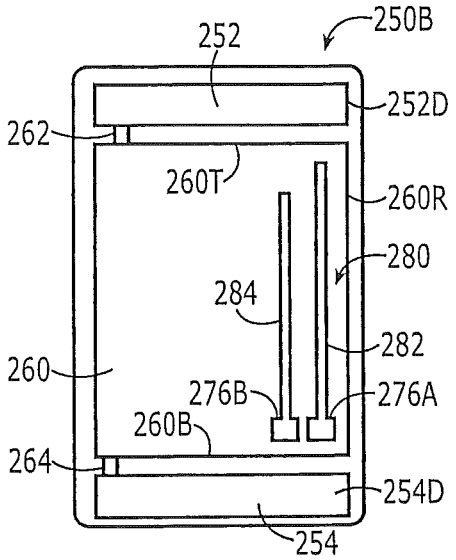
FIGS. 3A and 3B are schematic and perspective drawings that illustrate an antenna structure including two antennas, a ground plane and a multi-band wave stop according to further embodiments.
Figure 3B:
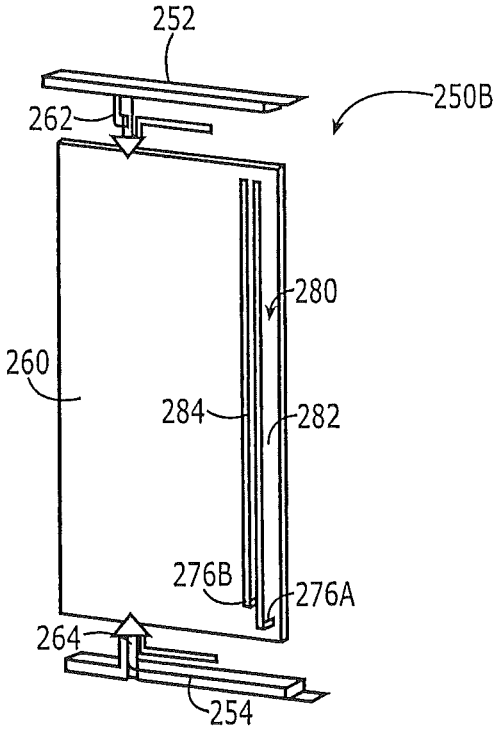

FIG. 3A is a schematic diagram of a MIMO antenna system 250B including dual radiating elements 252, 254 according to further embodiments. FIG. 3B is a perspective view of the MIMO antenna system 250B, while FIG. 3C is a graph of correlation coefficient of the two radiating elements 252, 254 as a function of frequency.

The antenna system 250B of FIGS. 3A and 3B includes a wavetrap structure 280 that includes two conductive strips 282, 284 connected to separate ground posts 276A, 276B.

In the embodiments illustrated in FIGS. 3A-3B, the first and second feed elements 262, 264 are positioned nearer to the left side 260L of the ground plane 260, so that the radiating elements 252, 254 each include an open end 252D, 254D that is spaced apart from the respective feed element 262, 264 by a distance that is almost the length of the radiating element.

Figure 3C:
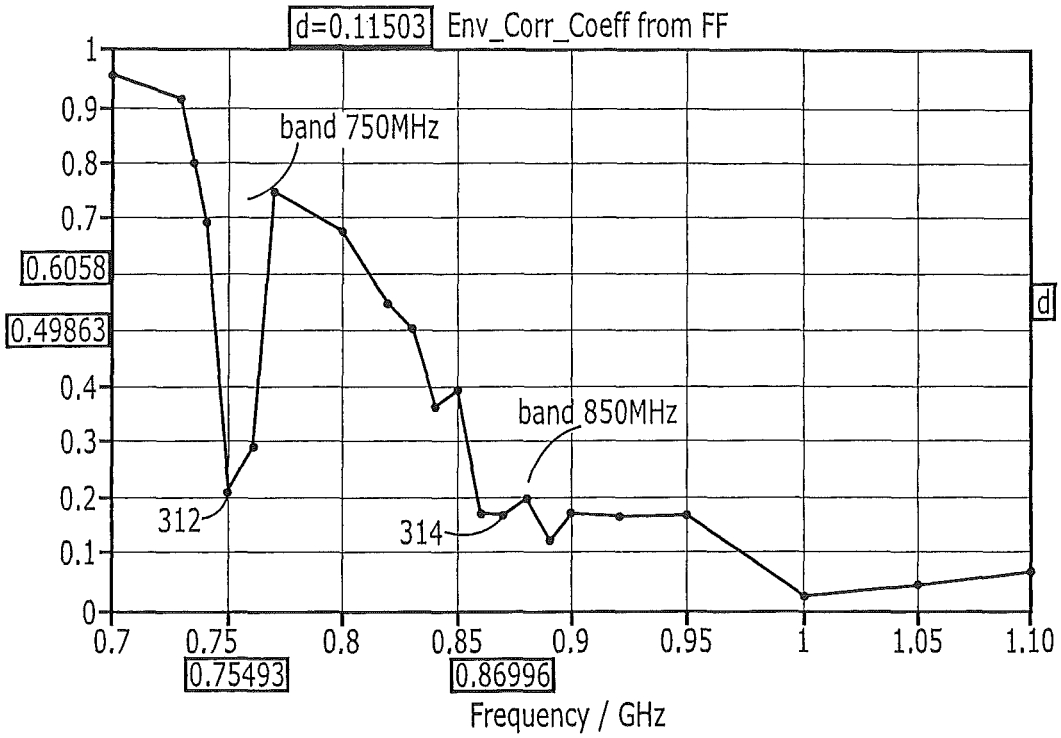
FIG. 3C is a graph of envelope correlation parameter measurements for the antenna of FIG. 3A.

FIG. 3C is a graph of correlation coefficient of the two radiating elements 252, 254 of FIGS. 3A-3B as a function of frequency. As shown therein, the antenna envelope correlation between the two radiating elements 252, 254 at 750 MHz is less than 0.3 (point 312), while the antenna envelope correlation between the two radiating elements 252, 254 at 850 MHz is less than 0.2 (point 314). Attaching the conductive strips of the multi-element wavetrap 290 to the ground plane 260 using separate ground posts can therefore decrease correlation between the radiating elements of a MIMO antenna.

Figure 4A:
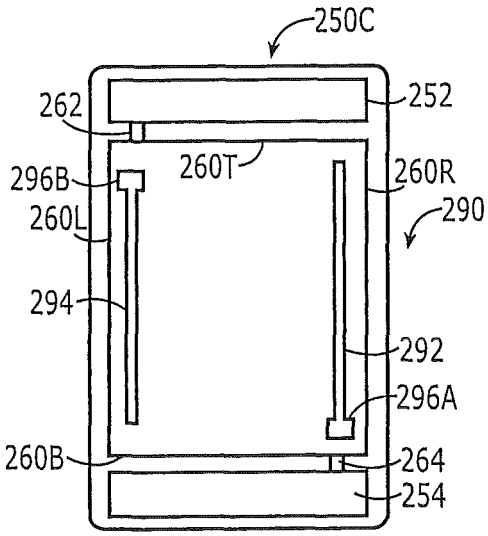
FIGS. 4A and 4B are schematic and perspective drawings that illustrate an antenna structure including two antennas, a ground plane and a multi-band wave stop according to further embodiments.
Figure 4B:
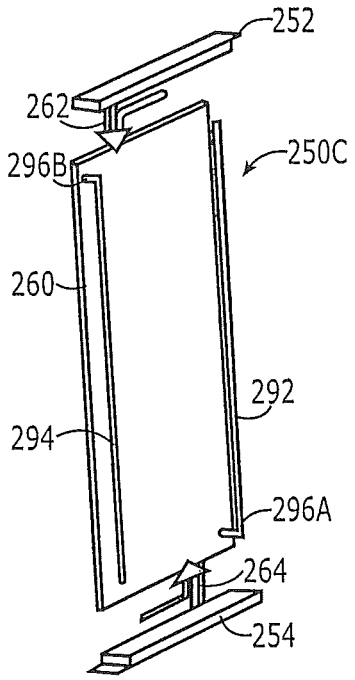
Figure 4C:
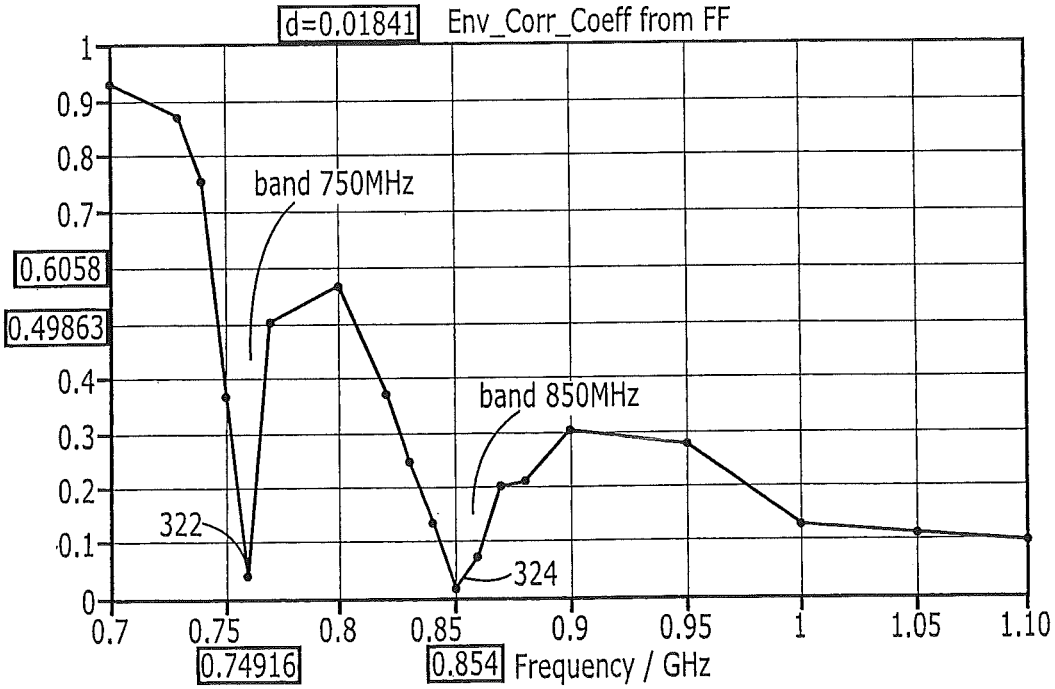
FIG. 4C is a graph of envelope correlation parameter measurements for the antenna of FIG. 4A.

FIG. 4A is a schematic diagram of a MIMO antenna system 250C including dual radiating elements 252, 254 according to further embodiments. FIG. 4B is a perspective view of the MIMO antenna system 450C, while FIG. 4C is a graph of correlation coefficient of the two radiating elements 252, 254 as a function of frequency.

In the embodiments illustrated in FIGS. 4A-4B, the first and second feed elements 262, 264 are positioned on opposite sides of the ground plane 260. The radiating elements 252, 254 each include an open end 252D, 254D that is spaced apart from the respective feed element 262, 264 by a distance that is almost the length of the radiating element.

The antenna system 250C of FIGS. 4A and 4B includes a wavetrap structure 280 that includes two conductive strips 292, 294 connected to separate ground posts 296A, 296B that are positioned near opposite corners of the ground plane 60. That is, the first ground post 296A is positioned close to the bottom end 260B and right side 260R of the ground plane 260, while the second ground post 296B is positioned close to the top end 260T and left side 260L of the ground plane 260.

The conductive strips 292, 294 extend in opposite directions along the ground plane 260. That is, the first ground post 296A is located near the bottom end 260B of the ground plane 260, and the first conductive strip 292 extends towards the top end 260T of the ground plane 260. The second ground post 296B is located near the top end 260T of the ground plane 260, and the second conductive strip 294 extends towards the bottom end 260B of the ground plane 260. Further, the first conductive strip 292 extends toward the open end 252D of the first radiating element 252, while the second conductive strip 294 extends toward the open end 254D of the second radiating element 254.

FIG. 4C is a graph of correlation coefficient of the two radiating elements 252, 254 of FIGS. 4A-4B as a function of frequency. As shown therein, the antenna envelope correlation between the two radiating elements 252, 254 at 750 MHz is less than 0.1 (point 322), while the antenna envelope correlation between the two radiating elements 252, 254 at 850 MHz is also less than 0.1 (point 324). Separating the conductive strips of the multi-element wavetrap 290 and having them run in opposite direction as shown in FIGS. 4A-4B can therefore decrease correlation between the radiating elements of a MIMO antenna.

Figure 5:
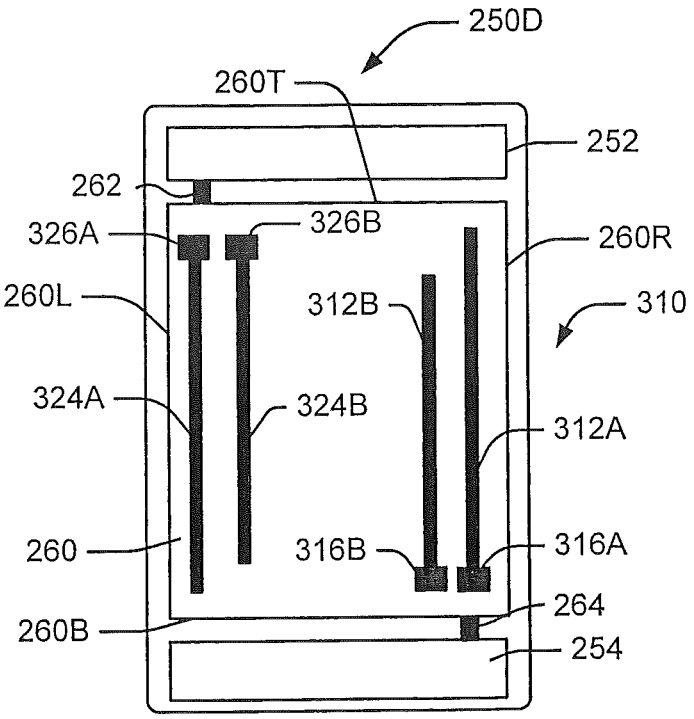
FIGS. 5 and 6 illustrate antenna structures according to further embodiments.

FIG. 5 is a schematic illustration of an antenna structure 250D according to further embodiments. The antenna structure 250D includes a wavetrap structure 310 that includes two multi-element wavetraps. A first multi-element wavetrap is provided on one side of the ground plane 260 and includes a first conductive strip 312A coupled to the ground plane 260 by a first ground post 316A and a second conductive strip 312B coupled to the ground plane 260 by a second ground post 316B. The first and second ground posts 316A, 316B are positioned near the feed element 264 for the lower radiating element 254, while the open ends of the first and second conductive strips 312A, 312B are positioned near the open end of the upper radiating element 252.

A second multi-element wavetrap is provided on the opposite side of the ground plane 260 and includes a third conductive strip 324A coupled to the ground plane 260 by a third ground post 326A and a fourth conductive strip 324B coupled to the ground plane 260 by a fourth ground post 326B. The third and fourth ground posts 326A, 326B are positioned near the feed element 262 for the upper radiating element 252, while the open ends of the first and second conductive strips 324A, 324B are positioned near the open end of the lower radiating element 254.

Figure 6:
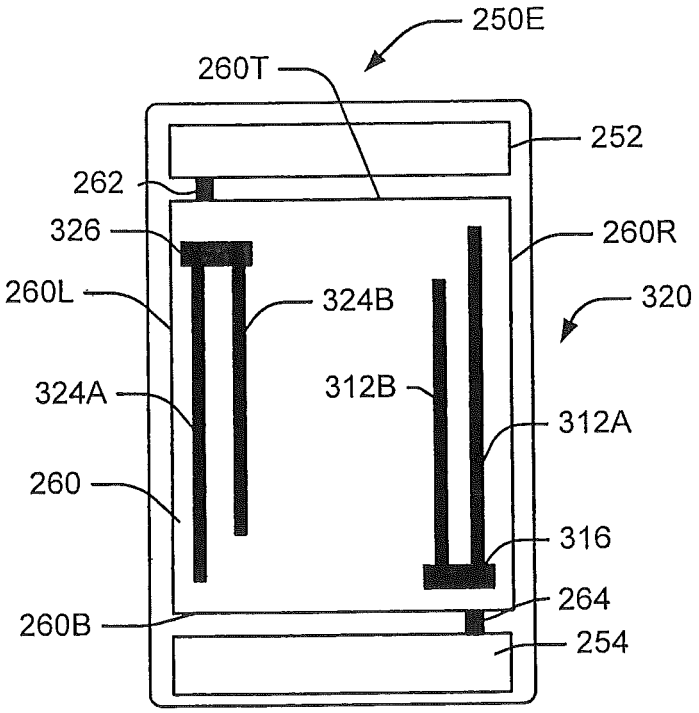

FIG. 6 is a schematic illustration of an antenna structure 250E according to further embodiments. The antenna structure 250E includes a wavetrap structure 320 that includes two multi-element wavetraps. A first multi-element wavetrap is provided on one side of the ground plane 260 and includes a first conductive strip 312A and a second conductive strip 312B coupled to the ground plane 260 by a first common ground post 316. The first common ground post 316 is positioned near the feed element 264 for the lower radiating element 254, while the open ends of the first and second conductive strips 312A, 312B are positioned near the open end of the upper radiating element 252.

A second multi-element wavetrap is provided on the opposite side of the ground plane 260 and includes a third conductive strip 324A and a fourth conductive strip 324B coupled to the ground plane 260 by a second common ground post 326. The second common ground posts 326 is positioned near the feed element 262 for the upper radiating element 252, while the open ends of the first and second conductive strips 324A, 324B are positioned near the open end of the lower radiating element 254.

It will be appreciated that wavetrap structures according to some embodiments can be realized using other structures besides strip lines, such as patch structures, spiral structures, meander structure and others. Various combinations of strips, patches, spirals, meanders, etc., may also be used.

Figure 7A:
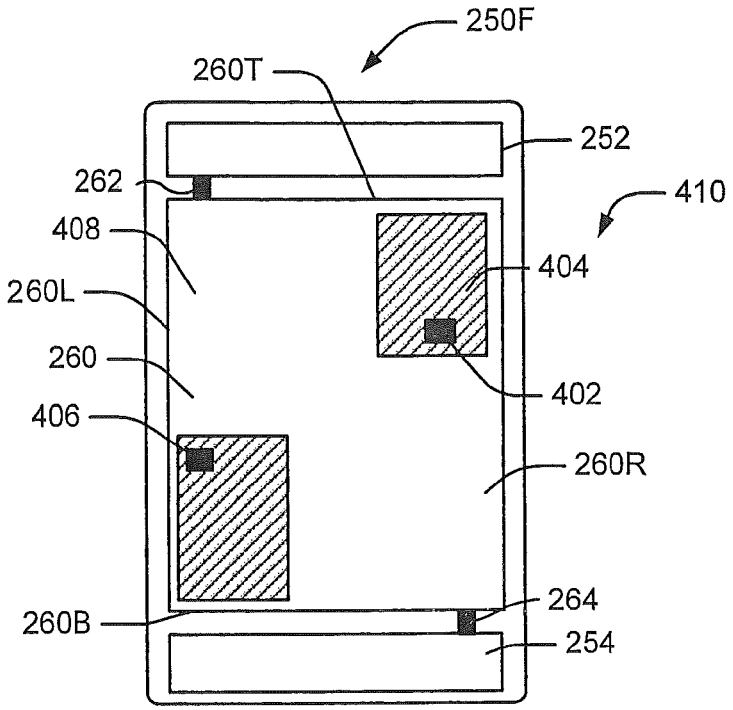
FIGS. 7A and 7B illustrate antenna structures according to still further embodiments.
Figure 7B:
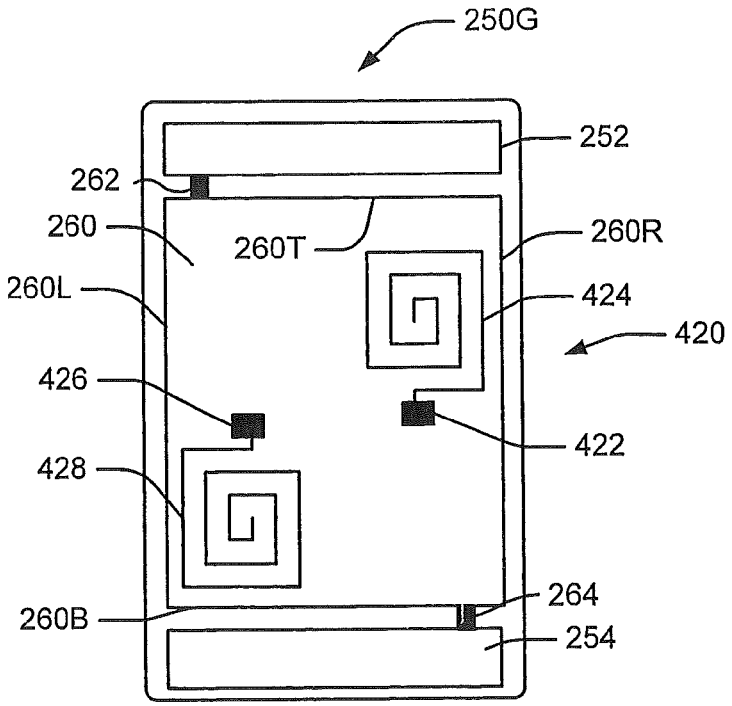

For example, FIG. 7A illustrates an antenna structure 250F including a wavetrap structure 410 that includes a first patch wavetrap structure 404 coupled to the ground plane 260 by a first ground post 402 and a second patch wavetrap structure 408 coupled to the ground plane 260 by a second ground post 406. Similarly, FIG. 7B illustrates an antenna structure 250G including a wavetrap structure 420 that includes a first spiral wavetrap 424 coupled to the ground plane 260 by a first ground post 422 and a second patch wavetrap structure 428 coupled to the ground plane 260 by a second ground post 426.

Figure 8:
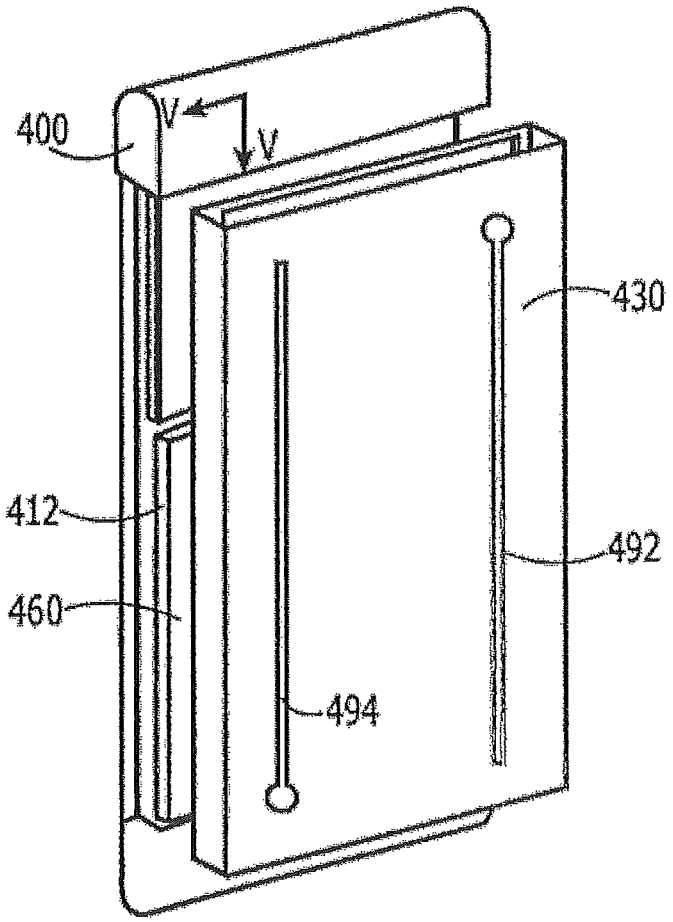
FIG. 8 is an exploded perspective drawing that illustrates components of a wireless terminal according to some embodiments.

FIG. 8 is an exploded perspective view illustrating components of a wireless communication terminal 400 that includes a MIMO antenna system in accordance with some embodiments. The wireless communication terminal 400 includes a main body 410 on which electronic circuitry 412 including the ground plane 460 of an antenna structure is provided. A nonconductive back cover 430 attaches to the main body 410. A plurality of conductive strips 492, 494 may be formed on the back cover 430 and may attach to the ground plane when the back cover 430 is attached to the main body 410 of the wireless communication terminal 400 to provide wavetrap structures as described above.

In general, increasing the distance between the wavetrap structure and the ground plane may increase the bandwidth of the wavetrap structure, Accordingly, in some embodiments, it may be desirable to provide the wavetrap structure on an external surface of the terminal, such as the back cover of the terminal, to place it as far as possible from the ground plane.

Figure 9A:
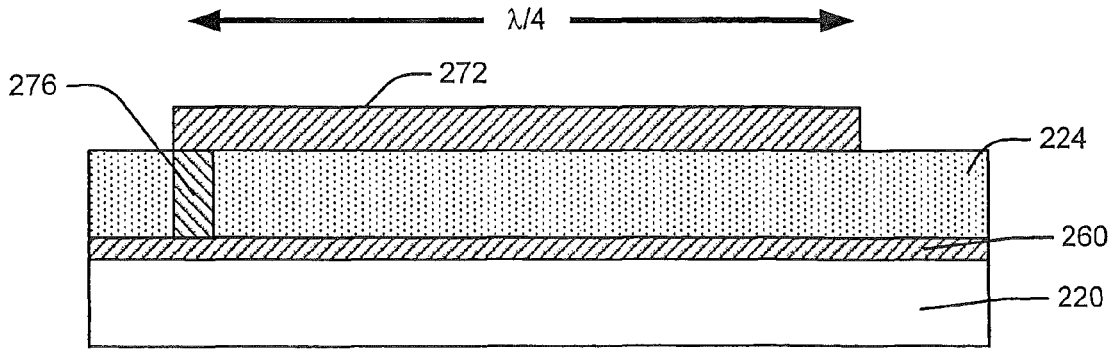
FIG. 9A illustrates a wavetrap element in detail.

FIG. 9A illustrates a wavetrap element in detail. As shown therein, a wavetrap element includes a ground post 276 that extends from a ground plane 260. The ground plane 260 may be provided on a substrate 220, such as a printed circuit board. A conductive strip 272 is connected to the ground post and extends across the ground plane. The conductive strip 272 is spaced apart from the ground plane by a dielectric layer 224, which may include plastic, air, etc. The conductive strip 272 has an electrical length that is equal to one quarter wavelength of a frequency that is to be dissipated by the wavetrap.

Figure 9B:
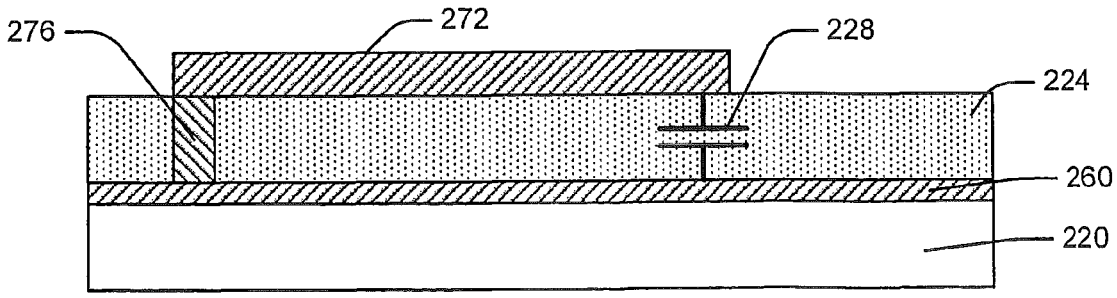
FIG. 9B illustrates a wavetrap element including a capacitive termination.

FIG. 9B illustrates a wavetrap element including a capacitive termination 228 between an end of the conductive strip opposite the ground post 276. A capacitive termination can be used to tune the resonant frequency of the wavetrap element, which can permit the physical length of the wavetrap element to be shortened.

Figure 9C:
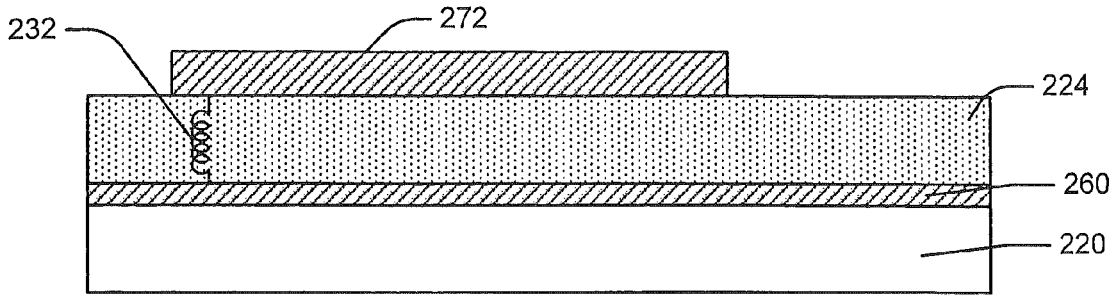
FIG. 9C illustrates a wavetrap element including an inductive feed.
Figure 9D:
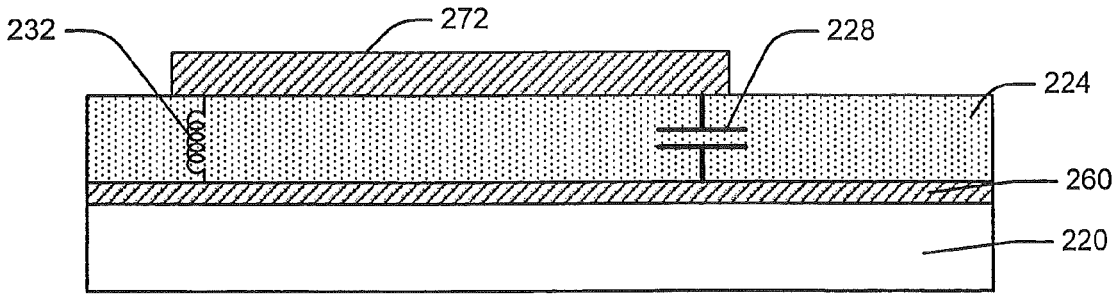
FIG. 9D illustrates a wavetrap element including an inductive feed and a capacitive termination.

FIG. 9C illustrates a wavetrap element including an inductive feed 232 that couples the conductive strip 272 to the ground plane 260, while FIG. 9D illustrates a wavetrap element including an inductive feed 232 and a capacitive termination 228. Including an inductive feed can permit further reduction in the physical length of the conductive strip 272.

Figure 10:
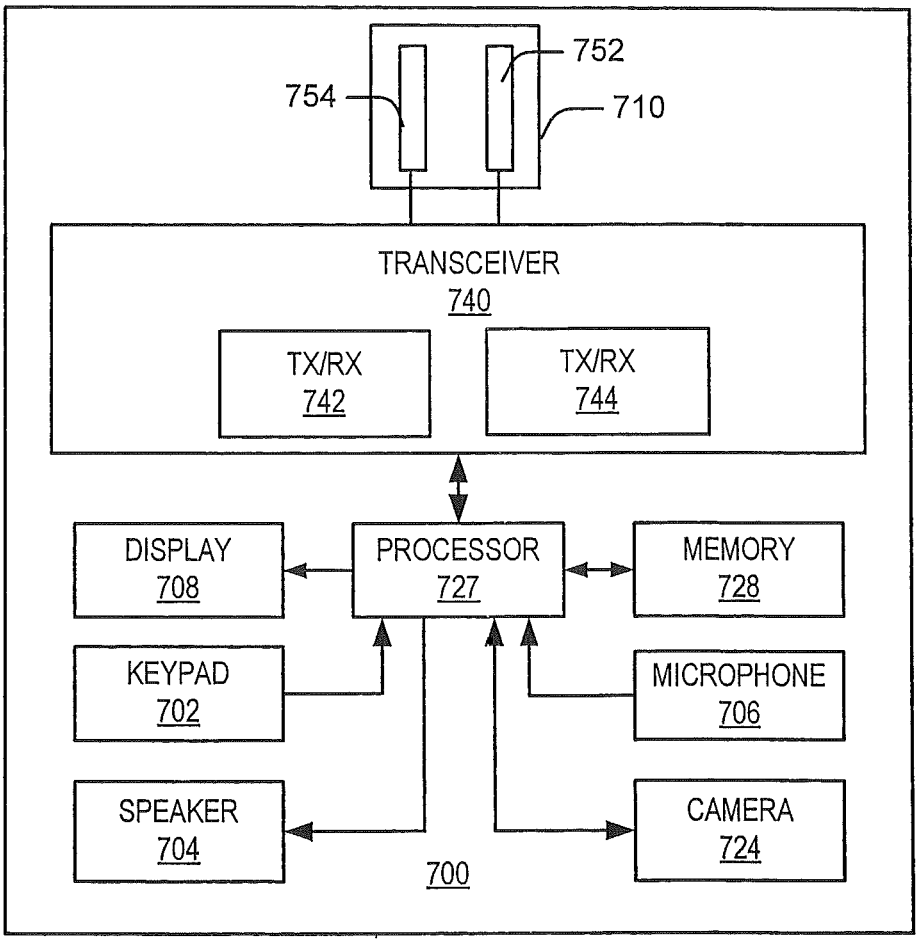
FIG. 10 is a block diagram of a wireless communication device including an antenna system in accordance with some embodiments.

FIG. 10 is a block diagram of a wireless communication terminal 700 that includes a MIMO antenna in accordance with some embodiments of the present invention. Referring to FIG. 7, the terminal 700 includes a MIMO antenna 710, a transceiver 740, a processor 727, and can further include a conventional display 708, keypad 702, speaker 704, mass memory 728, microphone 706, and/or camera 724, one or more of which may be electrically grounded to the same ground plane (e.g., ground plane 160 in FIG. 1) as the MIMO antenna 710. The MIMO antenna 710 may be structurally configured as shown for MIMO antenna 250A of FIGS. 2A-2B, MIMO antenna 250B of FIGS. 3A-3B, MIMO antenna 250C of FIGS. 4A-4C, or may be configured in accordance with various other embodiments of the present invention. Moreover, although various MIMO antennas are illustrated herein as ground free monopole antennas, the antennas could also include planar inverted F-antennas (PIFA) radiating elements and/or on-ground antenna radiating elements as well.

The transceiver 740 may include transmit/receive circuitry (TX/RX) that provides separate communication paths for supplying/receiving RF signals to different radiating elements of the MIMO antenna 710 via their respective RF feeds. Accordingly, when the MIMO antenna 710 includes two radiating antenna elements 752, 754, such as shown in FIG. 6, the transceiver 740 may include two transmit/receive circuits 742,744 connected to different ones of the antenna elements via the respective RF feeds.

The transceiver 740 is operational cooperation with the processor 727 may be configured to communicate according to at least one radio access technology in two or more frequency ranges. The at least one radio access technology may include, but is not limited to, WLAN (e.g., 802.11), WiMAX (Worldwide Interoperability for Microwave Access), TransferJet, 3GPP LTE (3rd Generation Partnership Project Long Term Evolution), Universal Mobile Telecommunications System (UMTS), Global Standard for Mobile (GSM) communication, General Packet Radio Service (GPRS), enhanced data rates for GSM evolution (EDGE), DCS, PDC, PCS, code division multiple access (CDMA), wideband-CDMA, and/or CDMA2000. Other radio access technologies and/or frequency bands can also be used in embodiments according to the invention.

It will be appreciated that certain characteristics of the components of the MIMO antennas shown in the Figures such as, for example, the relative widths, conductive lengths, and/or shapes of the radiating elements, the conductive neutralization lines, and/or other elements of the MIMO antennas may vary within the scope of the present invention. Thus, many variations and modifications can be made to the embodiments without substantially departing from the principles of the present invention. All such variations and modifications are intended to be included herein within the scope of the present invention, as set forth in the following claims.

What is claimed is:

1. An antenna comprising:

a first radiating element;

a second radiating element;

a common ground plane between the first radiating element and the second radiating element; and a wavetrap structure coupled to the ground plane and configured to reduce correlation between the first and second radiating elements at first and second RF frequencies;

wherein the wavetrap structure comprises:

a first ground post connected to the ground plane;

a second ground post connected to the ground plane;

a first conductive strip coupled to the first ground post and having an electrical length that is one quarter of a wavelength of the first RF frequency; and a second conductive strip coupled to the second ground post and having an electrical length that is one quarter of a wavelength of the second RF frequency;

wherein the ground plane has a first end and a second end opposite the first end;

the first radiating element is adjacent the first end of the ground plane and the second radiating element is adjacent the second end of the ground plane;

the first and second ground posts are proximate the first end of the ground plane;

the first conductive strip extends away from the first ground post toward the second end of the ground plane; and the second conductive strip extends away from the second ground post toward the second end of the ground plane; and the ground plane has a first side and a second side opposite the first side;

the antenna further comprising:

a first feed element coupled to the first radiating element at a first end of the first radiating element proximate the first side of the ground plane; and a second feed element coupled to the second radiating element at a first end of the second radiating element proximate the first side of the ground plane;

the first ground post and the second ground post are proximate the second side of the ground plane;

the first conductive strip extends from the first ground post toward an open end of the second radiating element opposite the first end of the second radiating element; and the second conductive strip extends from the second ground post toward the open end of the second radiating element.

2. The antenna of claim 1, further comprising a capacitive element between an open end of the first conductive strip opposite the ground post and the ground plane.

3. The antenna of claim 1, wherein the ground post comprises an inductive element.

4. The antenna of claim 3, further comprising a capacitive element between an open end of the first conductive strip opposite the ground post and the ground plane.

5. The antenna of claim 1, wherein the first and second radiating elements have an envelope correlation coefficient less than 0.5 for a first frequency in the first RF frequency range and for a second frequency in the second RF frequency range.

6. The antenna of claim 1, wherein the wavetrap structure comprises: a ground post connected to the ground plane; and a patch structure coupled to the ground post and configured to resonate at the first RF frequency.

7. The antenna of claim 1, wherein the wavetrap structure comprises: a ground post connected to the ground plane; and a spiral structure coupled to the ground post and configured to resonate at the first RF frequency.

8. A wireless terminal, comprising:

a transceiver; and an antenna coupled to the transceiver, the antenna comprising:

a first radiating element;

a second radiating element;

a common ground plane between the first radiating element and the second radiating element; and a wavetrap structure coupled to the ground plane and configured to reduce correlation between the first and second radiating elements at first and second RF frequencies;

wherein the wavetrap structure comprises:

a first ground post connected to the ground plane;

a second ground post connected to the ground plane;

a first conductive strip coupled to the first ground post and having an electrical length that is one quarter of a wavelength of the first RF frequency; and a second conductive strip coupled to the second ground post and having an electrical length that is one quarter of a wavelength of the second RF frequency;

wherein:

the ground plane has a first end and a second end opposite the first end;

the first radiating element is adjacent the first end of the ground plane and the second radiating element is adjacent the second end of the ground plane;

the first ground post is proximate the second end of the ground plane;

the second ground post is proximate the first end of the ground plane;

the first conductive strip extends away from the first ground post toward the first end of the ground plane; and the second conductive strip extends away from the second ground post toward the second end of the ground plane;

wherein the ground plane has a first side and a second side opposite the first side; the antenna further comprising:

a first feed element coupled to the first radiating element at a first end of the first radiating element proximate the first side of the ground plane; and a second feed element coupled to the second radiating element at a first end of the second radiating element proximate the second side of the ground plane;

the first ground post is proximate the second side of the ground plane;

the second ground post is proximate the first side of the ground plane;

the first conductive strip extends from the first ground post toward a second end of the first radiating element opposite the first end of the first radiating element; and the second conductive strip extends from the second ground post toward a second end of the second radiating element opposite the first end of the second radiating element.

9. The wireless terminal of claim 8, further comprising a housing, wherein the ground plane is disposed within the housing and wherein the wavetrap structure is provided on an outer surface of the housing.

* * * * *